US009914319B2

(12) United States Patent
Hasegawa

(10) Patent No.: US 9,914,319 B2
(45) Date of Patent: Mar. 13, 2018

(54) APPARATUS FOR TURNING PAGE AND METHOD FOR TURNING PAGE

(71) Applicant: CASIO COMPUTER CO., LTD., Shibuya-ku, Tokyo (JP)

(72) Inventor: Hirokazu Hasegawa, Koganei (JP)

(73) Assignee: Casio Computer Co., Ltd., Tokyo (JP)

( * ) Notice: Subject to any disclaimer, the term of this patent is extended or adjusted under 35 U.S.C. 154(b) by 296 days.

(21) Appl. No.: 14/936,325

(22) Filed: Nov. 9, 2015

(65) Prior Publication Data

US 2016/0167419 A1 Jun. 16, 2016

(30) Foreign Application Priority Data

Dec. 15, 2014 (JP) ..... 2014-252661

(51) Int. Cl.
*B42D 9/06* (2006.01)

(52) U.S. Cl.
CPC ..... *B42D 9/06* (2013.01)

(58) Field of Classification Search
CPC ..... B42D 9/06
See application file for complete search history.

(56) References Cited

U.S. PATENT DOCUMENTS 5,247,755 A * 9/1993 Sato ..... B42D 9/06 40/476
6,611,362 B2 * 8/2003 Mandel ..... H04N 1/00607 348/455
8,982,428 B2 3/2015 Hasegawa
9,056,516 B2 6/2015 Hasegawa
9,365,071 B2 6/2016 Hasegawa
9,421,810 B2 8/2016 Hasegawa
9,457,609 B2 10/2016 Hasegawa
9,481,194 B2 * 11/2016 Hasegawa ..... B42D 9/06
2007/0285742 A1 * 12/2007 Wolberg ..... B42D 9/04 358/498
2014/0078561 A1 3/2014 Hasegawa
2014/0168726 A1 6/2014 Hasegawa
2014/0366412 A1 12/2014 Hasegawa
(Continued)

FOREIGN PATENT DOCUMENTS

JP 05155179 A 6/1993
JP 2003320769 A 11/2003
JP 2014117893 A 6/2014

OTHER PUBLICATIONS

Japanese Office Action (and English translation thereof) dated Jan. 4, 2017 issued in Japanese counterpart Application No. 2014-252661.

*Primary Examiner* — Robert W Horn
(74) *Attorney, Agent, or Firm* — Holtz Holtz & Volek PC

(57) ABSTRACT

An apparatus which turns a page of an open book includes a tuning mechanism, a drive unit and a control unit. The turning mechanism brings a predetermined member into contact with a page at a departure position and separates the page from the predetermined member at a destination position. The page is moved with the predetermined member. The drive unit drives the turning mechanism to make the predetermined member perform a to-and-fro movement between the departure position and the destination position. The control unit which controls the drive unit to temporarily stop the movement of the predetermined member on a way to the destination position from the departure position.

10 Claims, 14 Drawing Sheets

(56) References Cited

U.S. PATENT DOCUMENTS

| | | | | |
|---|---|---|---|---|
| 2015/0174942 | A1 | 6/2015 | Hasegawa | |
| 2015/0239277 | A1 | 8/2015 | Hasegawa | |
| 2015/0375557 | A1 | 12/2015 | Hasegawa | |
| 2016/0167419 | A1* | 6/2016 | Hasegawa | B42D 9/06 281/15.1 |
| 2017/0099404 | A1* | 4/2017 | Hasegawa | B42D 9/04 |

* cited by examiner

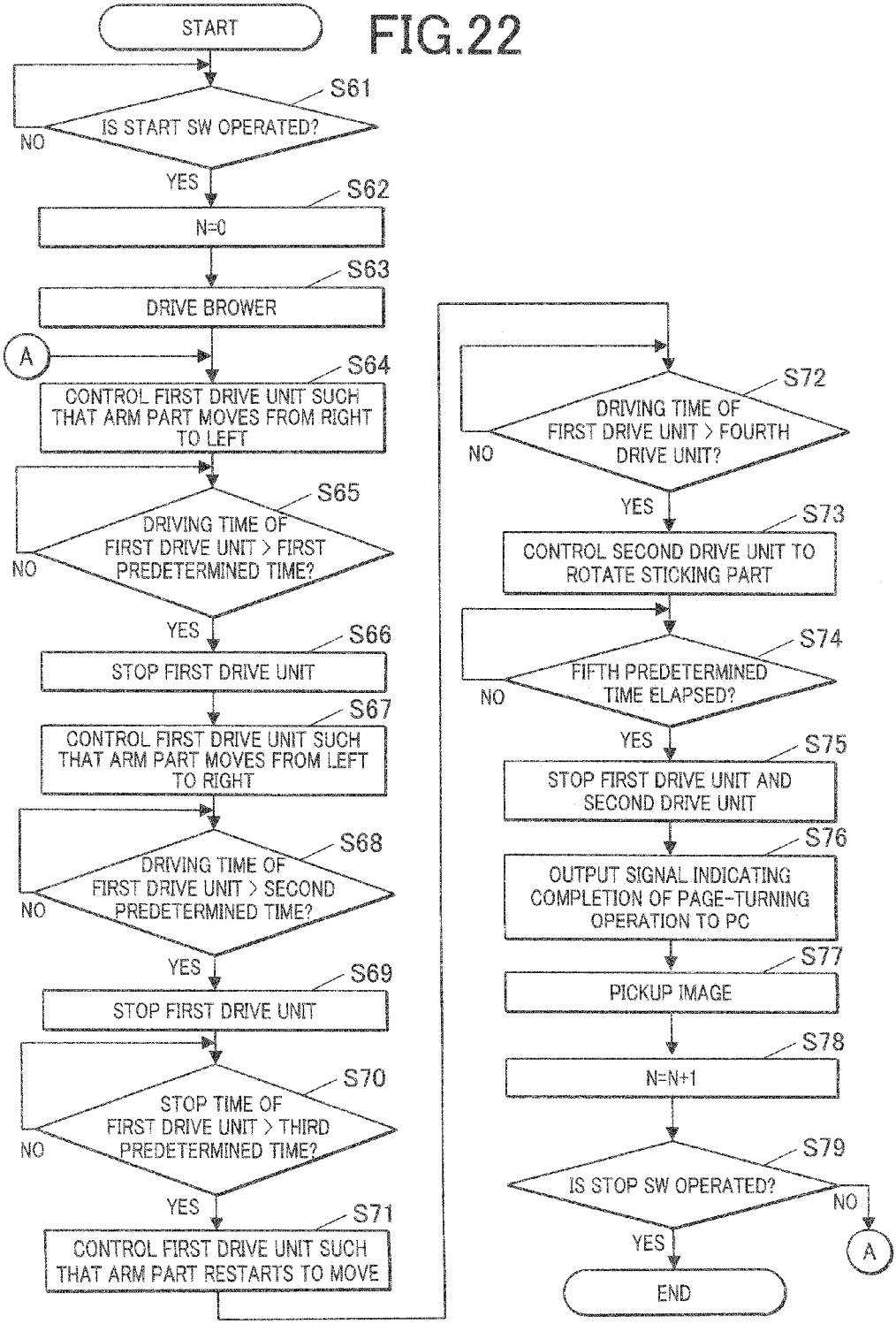
FIG.22
START
S61
IS START SW OPERATED?
NO
YES
S62
N=0
S63
DRIVE BROWER
A
S64
CONTROL FIRST DRIVE UNIT SUCH THAT ARM PART MOVES FROM RIGHT TO LEFT
S65
DRIVING TIME OF FIRST DRIVE UNIT > FIRST PREDETERMINED TIME?
NO
YES
S66
STOP FIRST DRIVE UNIT
S67
CONTROL FIRST DRIVE UNIT SUCH THAT ARM PART MOVES FROM LEFT TO RIGHT
S68
DRIVING TIME OF FIRST DRIVE UNIT > SECOND PREDETERMINED TIME?
NO
YES
S69
STOP FIRST DRIVE UNIT
S70
STOP TIME OF FIRST DRIVE UNIT > THIRD PREDETERMINED TIME?
NO
YES
S71
CONTROL FIRST DRIVE UNIT SUCH THAT ARM PART RESTARTS TO MOVE
S72
DRIVING TIME OF FIRST DRIVE UNIT > FOURTH DRIVE UNIT?
NO
YES
S73
CONTROL SECOND DRIVE UNIT TO ROTATE STICKING PART
S74
FIFTH PREDETERMINED TIME ELAPSED?
NO
YES
S75
STOP FIRST DRIVE UNIT AND SECOND DRIVE UNIT
S76
OUTPUT SIGNAL INDICATING COMPLETION OF PAGE-TURNING OPERATION TO PC
S77
PICKUP IMAGE
S78
N=N+1
S79
IS STOP SW OPERATED?
NO
A
YES
END

APPARATUS FOR TURNING PAGE AND METHOD FOR TURNING PAGE

CROSS REFERENCE TO RELATED APPLICATION

This application is based upon and claims the benefit of priority under 35 USC 119 of Japanese Patent Application No. 2014-252661 filed on Dec. 15, 2014, the entire disclosure of which, including the description, claims, drawings and abstract, is incorporated herein by reference in its entirety.

BACKGROUND OF THE INVENTION

1. Field of the Invention

The present invention relates to an apparatus for turning pages and a method for turning pages.

2. Description of Related Art

Conventionally, as a device to turn pages of a book or the like, there is known a page-turning device which sticks to each page of piled pages with a sticking plate to lift and turn pages (for example, refer to JP 2003-320769 A).

In a case where a page is turned by sticking, if the page is a thin paper such as high-quality paper, there is a possibility that multiple pages are lifted in an overlapped state and each page cannot be turned one by one.

SUMMARY OF THE INVENTION

According to a first aspect of the present invention, there is provided an apparatus which turns a page of an open book, including: a turning mechanism which brings a predetermined member into contact with a page at a departure position and separates the page from the predetermined member at a destination position, the page being moved with the predetermined member; a drive unit which drives the turning mechanism to make the predetermined member perform a to-and-fro movement between the departure position and the destination position; and a control unit which controls the drive unit to temporarily stop the movement of the predetermined member on a way to the destination position from the departure position.

According to a second aspect of the present invention, there is provided a method for turning a page of an open book, including: making a predetermined member perform a to-and-fro movement between a departure position and a destination position such that the predetermined member is brought into contact with a page at the departure position and the page is separated from the predetermined member at the destination position, the page being moved with the predetermined member; and stopping the predetermined member temporarily on a way to the destination position from the departure position.

BRIEF DESCRIPTION OF THE DRAWINGS

The present invention will become more fully understood from the detailed description given hereinafter and the accompanying drawings, which are given by way of illustration only and thus are not intended to limit the present invention, wherein:

FIG. 22 is a flowchart of page-turning processing by the page-turning device of the embodiment;

DETAILED DESCRIPTION OF THE PREFERRED EMBODIMENT

Hereinafter, an embodiment of the present invention will be described with reference to the drawings. Though various technical limitations which are preferable to carry out the present invention are added to the embodiment described below, the scope of the invention is not limited to the following embodiment and the illustrated examples.

Figure 1:
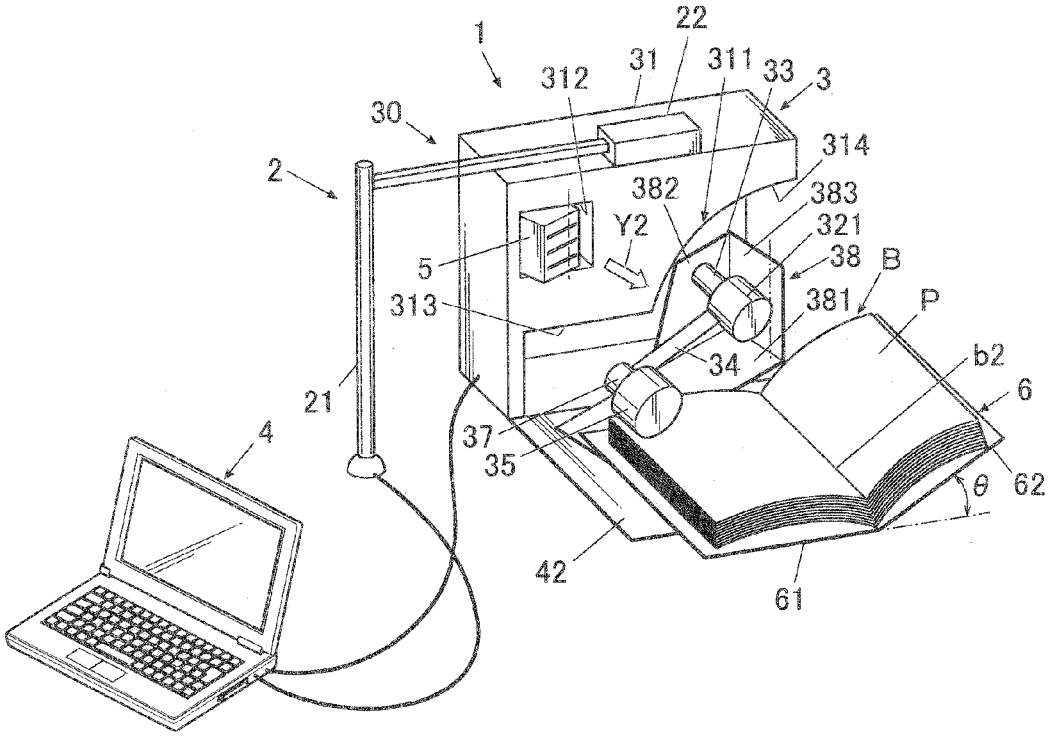
FIG. 1 is a perspective view schematically showing the configuration of a document camera system according to an embodiment of the present invention.

FIG. 1 is a perspective view schematically showing the configuration of a document camera system according to the present embodiment. In the explanation hereinafter, pages P of a book B are turned from left to right.

As shown in FIG. 1, the document camera system 1 includes: a document camera 2 as an image pickup unit which picks up images of pages P of the book B; a page-turning device 3 which turns pages P of the book B; and a personal computer 4 connected to the document camera 2 and the page-turning device 3 such that the computer 4 can communicate with the document camera 2 and the page-turning device 3.

The document camera 2 includes a stand part 21 and a camera 22 attached to the upper end of the stand part 21. The stand part 21 is inclinable in the front-back direction and the left-right direction, and extensible in the up-down direction, so that a positional relationship of the book B and the camera 22 can be adjusted. A lens of the camera 22 faces downward such that the book B comes within an angle of view. A position-adjustment mechanism is disposed at the joining portion of the camera 22 and the stand part 21. The position-adjustment mechanism enables the facing direction of the lens of the camera 22 to be adjusted.

The page-turning device 3 includes: a support base 6 which supports the book B being opened and a turning unit 30 which holds a page P at a departure position of pages P of the book B on the support base 6 and which releases the holding of the page P at a destination position of pages P.

The support base 6 includes a couple of support plates 61, 62 which can be folded up by using a hinge (not shown in drawings). When pages P of the book B are turned from left to right, the support plate 61 of the support plates 61, 62 which is disposed on the left is laid on the desk, and the support plate 62 which is disposed on the right is placed on the desk such that the support plate 62 is raised and inclined at a predetermined angle with respect to the support plate 61. Pages P at the departure position is placed on the support plate 61, while pages P at the destination position is placed on the support plate 62.

Thereby, the support base 6 supports the book B such that the pages P at the destination position are raised around a seam b2 of the book B with respect to the pages P at the departure position. Since the couple of support plates 61, 62 can be folded up by the hinge, an angle between the support plates 61, 62 is adjustable. Therefore, the inclined angle θ between the pages P at the destination position and the horizontal plane is adjustable. The inclined angle θ is preferably adjusted to 30 to 45 degrees.

Figure 2:
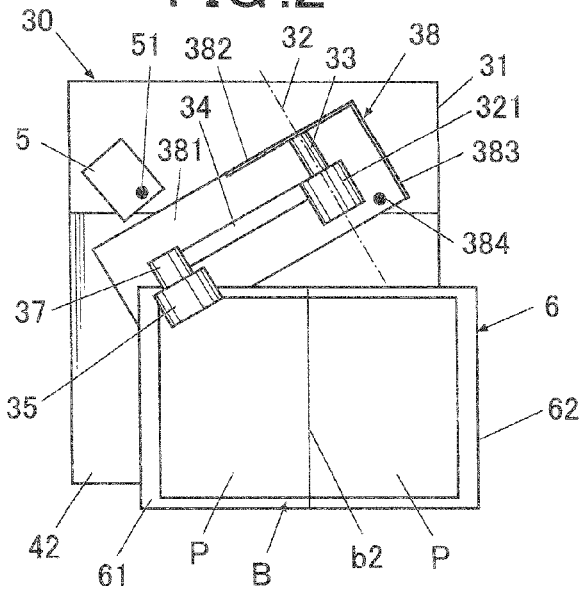
FIG. 2 is a top view schematically showing the elementary configuration of a page-turning device according to the embodiment.
Figure 3:
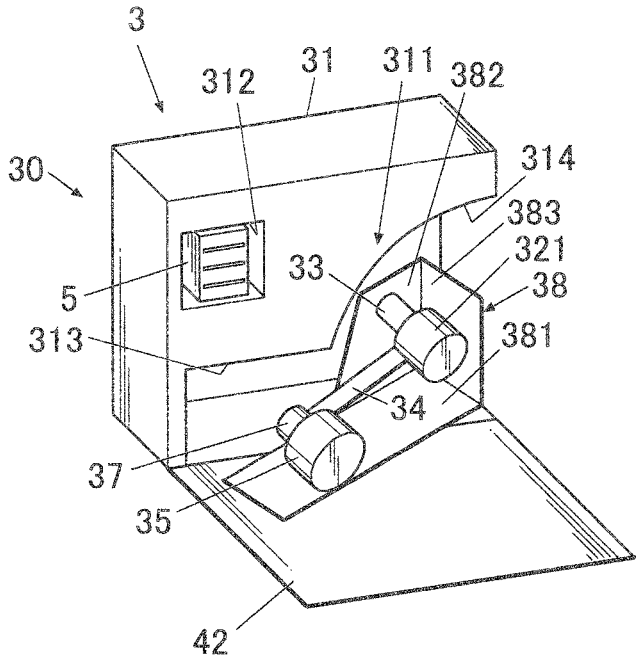
FIG. 3 is a perspective view schematically showing the elementary configuration of the page-turning device according to the embodiment.
Figure 4:
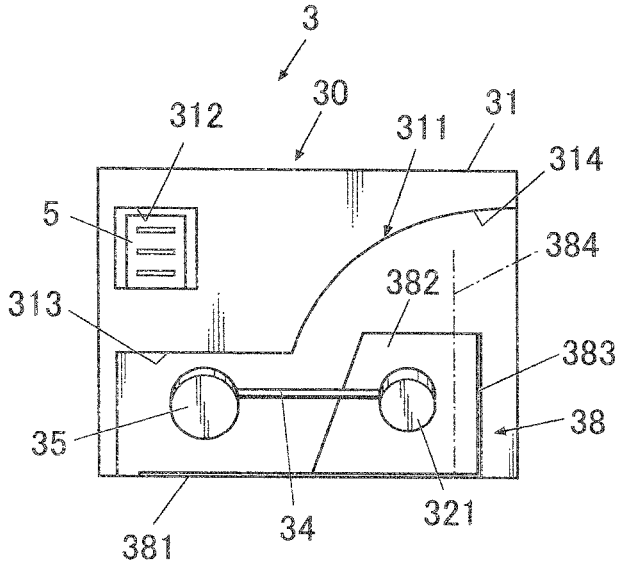
FIG. 4 is a front view schematically showing the elementary configuration of the page-turning device according to the embodiment.
Figure 5:
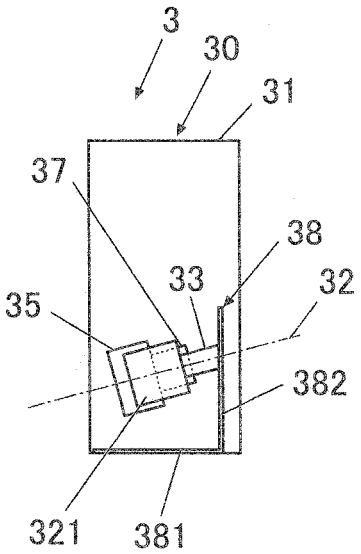
FIG. 5 is a schematic side view of the internal structure of the page-turning device according to the embodiment.

FIG. 2 is a top view of an elementary configuration of the page-turning device 3. FIG. 3 is a perspective view schematically showing the elementary configuration of the page-turning device 3. FIG. 4 is a front view schematically showing the elementary configuration of the page-turning device 3. FIG. 5 is a side view schematically showing an internal configuration of the page-turning device 3.

With reference to FIGS. 1 to 5, the turning unit 30 includes a substantially rectangular parallelepiped case 31; a first drive unit (drive unit) 33, such as a motor, including a drive shaft 32; an arm part 34 which swings about the drive shaft 32; a sticking part 35 disposed at the tip of the arm part 34 to stick to a page P of the book B; a mount 38 supporting the first drive unit 33, the arm part 34, and the sticking part 35; a blower 5 to blow air through a region above the pages P at the departure position onto the pages P at the destination position; and a control unit 36 (not shown in FIGS. 1 to 5; see FIG. 18) to control the components.

The case 31 accommodates the first drive unit 33, the arm part 34, the sticking part 35, the mount 38, the blower 5, and the control unit 36. The case 31 has a first accommodation recess 311 for accommodating the first drive unit 33, the arm part 34, the sticking part 35, and the mount 38, and a second accommodation recess 312 for accommodating the blower 5, on the main face of the case 31. The control unit 36 is disposed completely inside the case 31 without exposure.

The first accommodation recess 311 is composed of a first recess portion 313 for accommodating the arm part 34 in a standby mode, and a second recess portion 314 shaped not to block the swing of the arm part 34. The first recess portion 313 has a rectangular shape along the bottom of the case 31. The second recess portion 314 has an approximately fan shape, adjoins an edge of the first recess portion 313, and is open on one side.

The second accommodation recess 312 has a rectangular shape and is disposed above the first recess portion 313.

The mount 38 can be horizontally turned in the first accommodation recess 311. The mount 38 includes a bottom plate 381, a support 382 standing from the distal edge of the bottom plate 381 to support the first drive unit 33, and a stopper 383 standing from an edge of the bottom plate 381 and adjoining the support 382. At the edge of the bottom plate 381, a turn shaft 384 exists about which the mount 38 can be horizontally turned. The drive shaft 32 of the first drive unit 33 supported by the support 382 is also adjacent to the edge of the bottom plate 381. In other words, the turn shaft 384 of the mount 38 is adjacent to the drive shaft 32.

Figure 6:
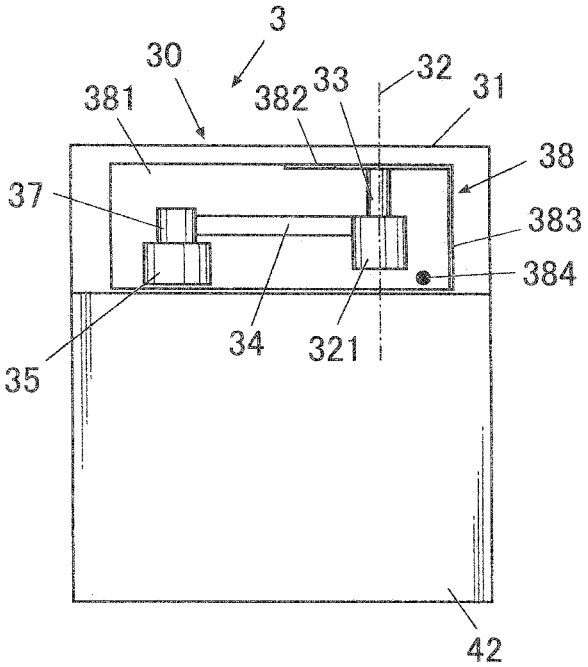
FIG. 6 is a top view of a mount accommodated in a case according to the embodiment.
Figure 7:
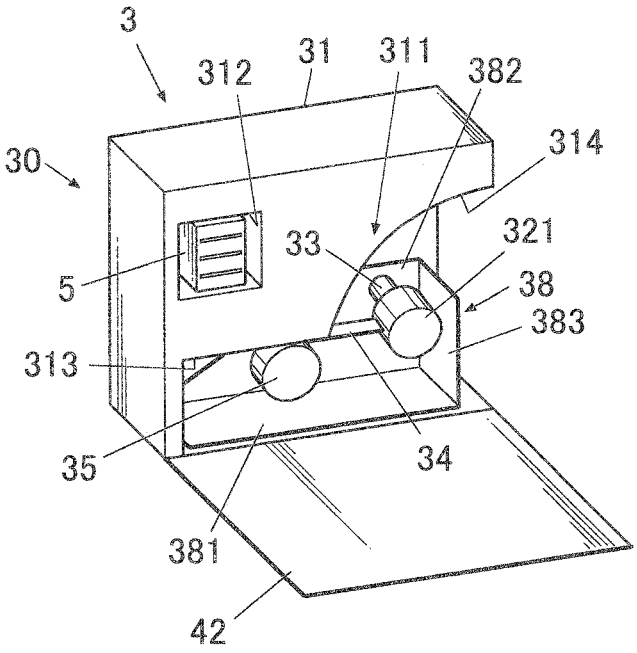
FIG. 7 is a perspective view of the mount accommodated in the case according to the embodiment.

FIGS. 6 and 7 are a top view and a perspective view of the mount 38 accommodated in the case 31, respectively. In contrast, FIGS. 2 to 5 respectively illustrate the mount 38 drawn out of the case 31 (in an operating mode). If the mount 38 in the state illustrated in FIGS. 2 to 5 is turned toward the case 31 about the turn shaft 384, the first drive unit 33, the arm part 34, the sticking part 35, and the mount 38 are accommodated in the first accommodation recess 311 as illustrated in FIGS. 6 and 7.

The case 31 is provided with a lid 42 which is openable and closable via a hinge (not shown) at the lower end. The open lid 42 is disposed on a desk, and the support base 6 is then mounted on the lid 42, as illustrated in FIGS. 1 and 2.

Figure 8:
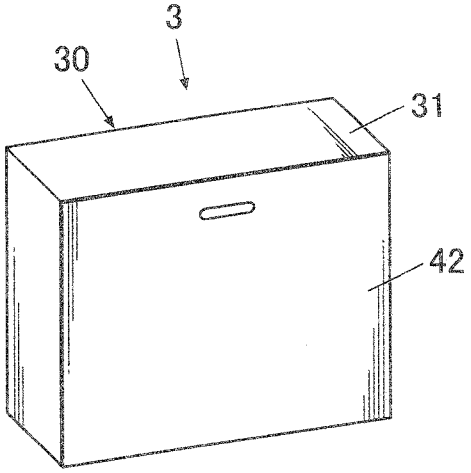
FIG. 8 is a perspective view of the case with a closed lid according to the embodiment.

FIG. 8 is a perspective view showing the case 31 when the lid 42 is in a closed state. When the first drive unit 33, the arm part 34, the sticking part 35, and the mount 38 are accommodated in the first accommodation recess 311, and the lid 42 is closed, the first drive unit 33, the arm part 34, the sticking part 35, and the mount 38 are covered.

As shown in FIG. 5, the drive shaft 32 of the first drive unit 33 in operation is inclined toward the book B side. As the drive shaft 32 rotates, the arm part 34 goes to and fro (shuttle operation) between the departure position and the destination position of pages P such that the arm part 34 draws a circular arc around the drive shaft 32. That is, the drive shaft 32 is an axis around which the arm part 34 swings. In the explanation hereinafter, a movement from the departure position to the destination position of pages P is referred to as an outward movement (a motion of going), and a movement from the destination position to the departure position is referred to as a homeward movement (a motion of return).

Figure 9A:
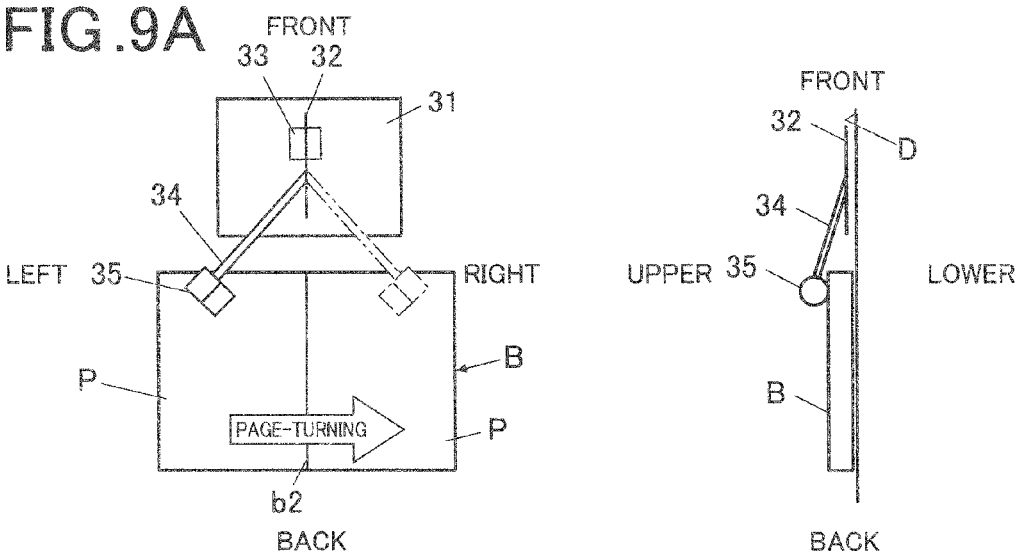
FIG. 9A, FIG. 9B and FIG. 9C schematically illustrate how inclination of a drive shaft of a first drive unit according to the embodiment affects a page-turning operation.
Figure 9B:
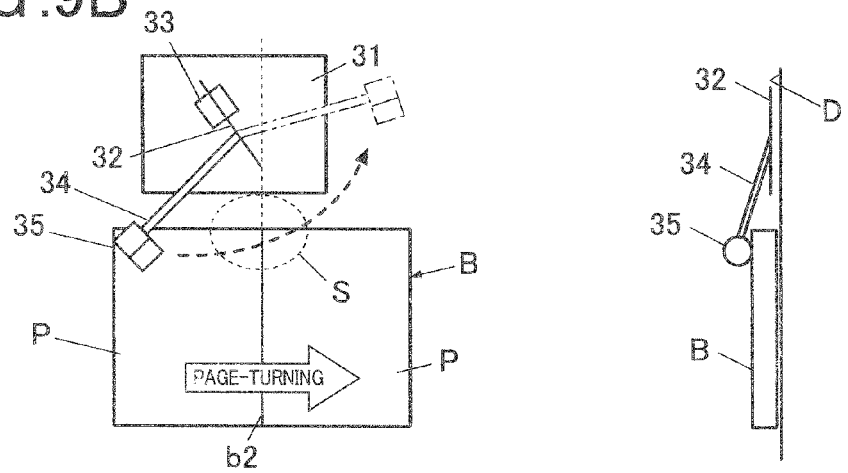
Figure 9C:
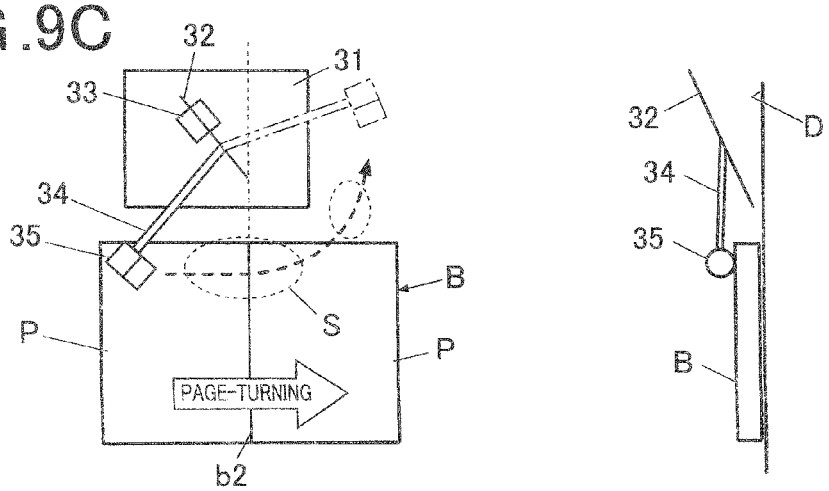

FIG. 9A, FIG. 9B and FIG. 9C schematically illustrate how the inclination of the drive shaft 32 affects the page-turning operation of pages P. FIG. 9A, FIG. 9B and FIG. 9C show the book B placed not on the support base 6 but directly on the desk D so that the configuration can be easily understood. FIG. 9A illustrates a case where the drive shaft 32 is horizontally disposed on the extension of the seam b2. In FIG. 9A, since the sticking part 35 moves along a route the symmetry axis of which corresponds to the seam b2, the sticking part 35 keeps in contact with the right-side page P at the destination position of pages P without being able to separate from the page P.

FIG. 9B illustrates a case where the drive shaft 32 is horizontal and inclined such that the back end of the drive shaft 32 turns to right-hand side with respect to the seam b2 of pages P and the front end of the drive shaft 32 as the base end turns to left-hand side with respect to the seam b2 of pages P. In the case shown in FIG. 9B, after the sticking part 35 sticks to a page P at the departure position, the arm part 34 rotates around the drive shaft 32, and at the end point of the outward movement, the sticking part 35 separates from the book B forward. Therefore, the sticking part 35 can easily separate from the sticking page P.

However, it has been found that, in the case shown in FIG. 93, since the book B and the sticking part 35 are distant from each other during the first half and the middle (shown as an ellipse part S) of a page-turning operation, a page P cannot always be turned smoothly.

FIG. 9C illustrates a case where the drive shaft 32 is inclined with respect to the seam b2 of the book B and is also inclined with respect to the horizontal plane. In this case, the distance between the book B and the sticking part 35 in the first phase to the middle phase (the ellipse S) of the page-turning is shorter than that in the case shown in FIG. 9B.

Figure 10A:
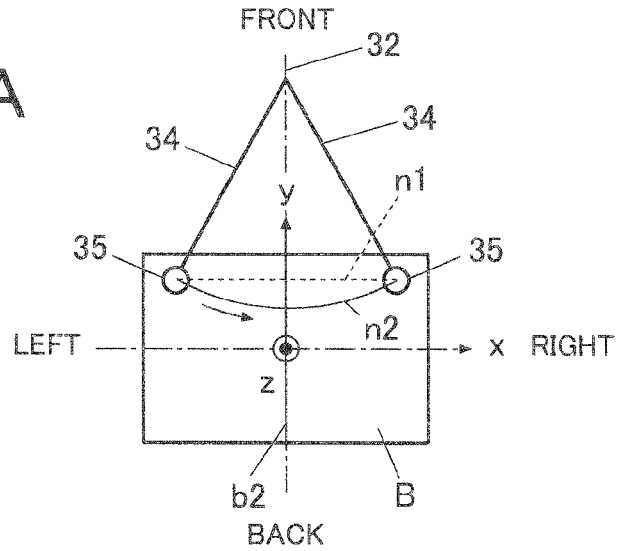
FIG. 10A, FIG. 10B and FIG. 10C are respectively a top view, a side view and an elevation view, schematically showing difference of routes of the sticking part between a case where the drive shaft of the first drive unit is horizontal and a case where the drive shaft is inclined with respect to the vertical line standing perpendicular to the seam.
Figure 10B:
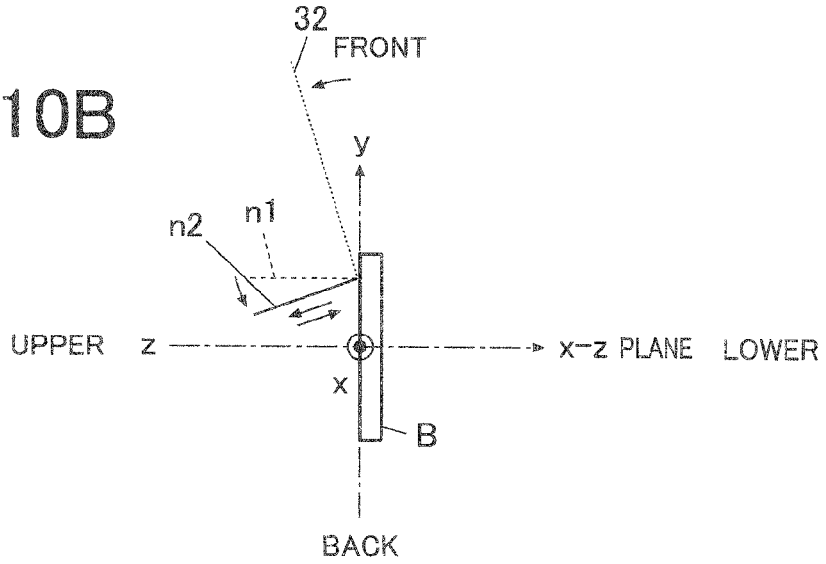
Figure 10C:
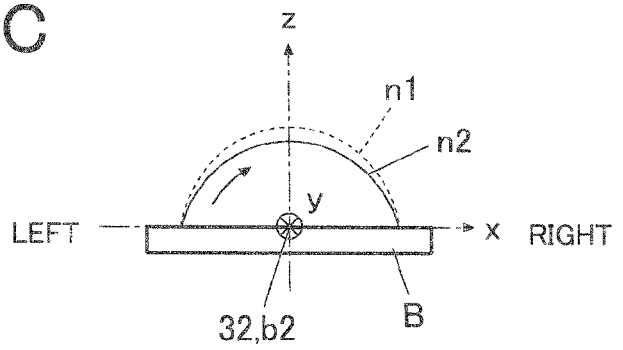

To be more specific, FIG. 10A, FIG. 10B and FIG. 10C schematically illustrate difference of routes of the sticking part 35 between a case where the drive shaft 32 is horizontal and a case where the drive shaft 32 is inclined with respect to the horizontal plane, wherein FIG. 10A is a top view, FIG. 10B is a side view, and FIG. 10C is an elevation view. In FIG. 10A, FIG. 10B and FIG. 10C, the left-right direction, the up-down direction and the vertical direction of the book B are respectively defined as an x direction, a y direction and a z direction. In FIG. 10A, FIG. 10B and FIG. 10C, the drive shaft 32 aligns with the seam b2 of the book B in order to clarify the point that the drive shaft 32 of the embodiment is inclined with respect to the horizontal plane. As shown in FIG. 10A, FIG. 10B and FIG. 10C, in the case where the drive shaft 32 is horizontal (dot lines in the figures), the locus n1 of the sticking part 35 is a straight line along the left-right direction in the top view (FIG. 10A), a straight line along the vertical direction in the side view (FIG. 10B) and a semicircle in the elevation view (FIG. 10C). On the other hand, in the case where the drive shaft 32 is inclined with respect to the horizontal plane (solid lines in the figures), the locus n2 of the sticking part 35 is a circular arc being convex backward in the top view (FIG. 10A), a straight line with its upper end being inclined backward in the side view (FIG. 10B) and a deformed semicircle in the elevation view (FIG. 10C). The locus n2 in FIG. 10B shows the locus plane of the driven sticking part 35 viewed from the side. It shows that the locus n2 is inclined with respect to a plane (x-z plane) including the left-right direction of the book B and a normal line of the book B.

As is known from FIG. 10C, the distance from the sticking part 35 to the seam b2 when the sticking part 35 passes over the seam b2 is shorter than the distance from the sticking part 35 to the seam b2 when the sticking part 35 sticks to a page P at the departure position. That is to say, the locus n2 can make the distance from the book B to the sticking part 35 when the sticking part 35 passes over the seam b2 shorter than the locus n1.

Thus, according to the embodiment shown in FIG. 9C, in the second phase of the page-turning, the distance between the book B (the seam b2) and the sticking part 35 becomes long, so that the sticking part 35 can easily separate from the sticking page P. Also, in the first phase to the middle phase (the ellipse S) of the page-turning operation, the distance between the book B (the seam b2) and the sticking part 35 becomes short, so that a page P can be slackened appropriately. Therefore, pages P can be reliably turned.

In the homeward movement, the moving direction is opposite to that in the outward movement, and the sticking part 35 takes the same route as that of the outward movement, moves keeping a distance from pages P and, in the end, sticks to another page P at the departure position of pages P. Repeating this shuttle operation progresses the page-turning operation of pages P.

In the present embodiment, the drive shaft 32 is inclined with respect to the seam b2 of the opened book B and is also inclined with respect to the horizontal plane as shown in FIG. 9C as an example. It is needless to say that if the drive shaft 32 is inclined with respect to either the seam b2 or the horizontal plane, these cases have their respective effects.

If the drive shaft 32 is inclined only with respect to the horizontal plane, as described later, a second drive unit 37 is driven or the sticking part 35 is configured in such a way as to stay at a higher position on the right than that on the left so that the sticking part 35 can easily separate from a page P.

Figure 11:
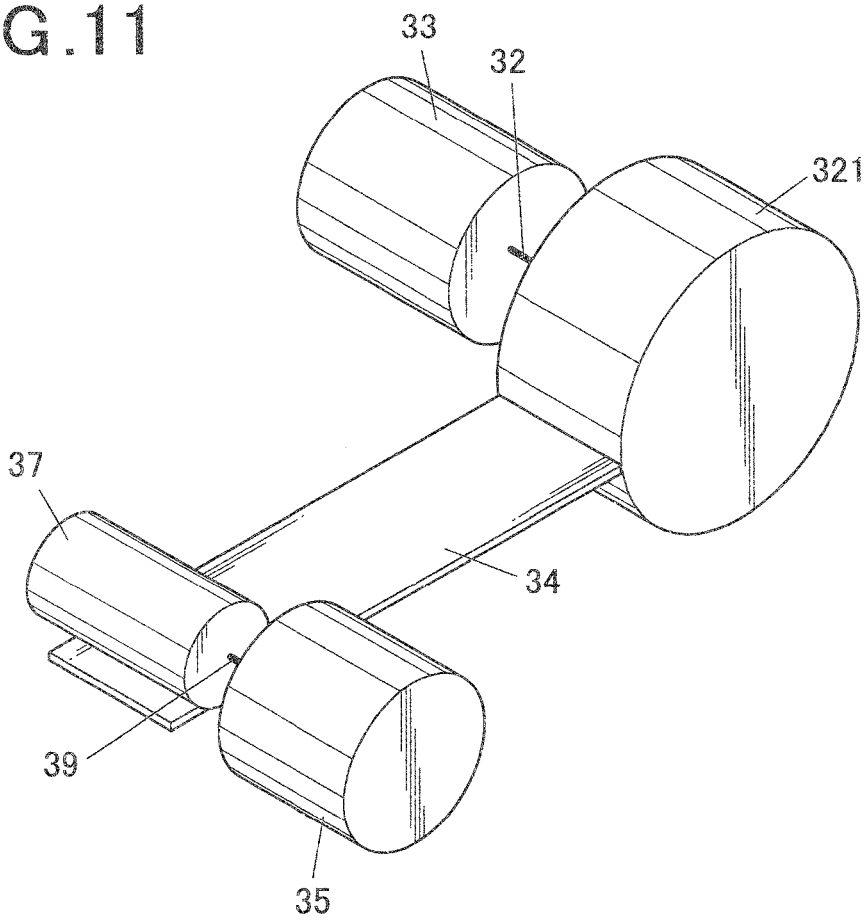
FIG. 11 is a schematic view schematically showing the configuration of the arm part according to the embodiment.

Next, specific configurations of the arm part 34 and the sticking part 35 will be explained. FIG. 11 is a perspective view schematically showing the configuration of the arm part 34. As illustrated in FIG. 11, the drive shaft 32 has a rotator 321 attached to one end of the drive shaft 32. The rotator 321 is attached to the arm part 34 such that the arm part 34 extends along a plane orthogonal to the drive shaft 32. The arm part 34 is a rectangular plate made of resin, for example. The arm part 34 has a flat planar cross-section cut along a plane perpendicular to the longitudinal direction of the arm part 34. The sticking part 35 is attached to the top end of the arm part 34 via the second drive unit 37 such as a motor.

The second drive unit 37 is disposed such that a drive shaft 39 of the second drive unit 37 is along a direction perpendicular to the longitudinal direction of the arm part 34. The sticking part 35 is removably attached to the drive shaft 39, and the sticking part 35 rotates as the drive shaft 39 rotates.

Figure 12:
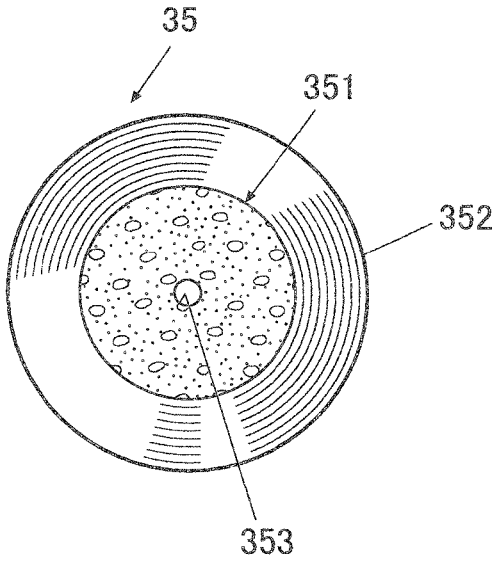
FIG. 12 is an elevation view schematically showing the configuration of the sticking part according to the embodiment.

FIG. 12 is an elevation view schematically showing the configuration of the sticking part 35. As shown in FIG. 12, the sticking part 35 is an adhesive member having a substantially-columnar shape. The sticking part 35 includes a columnar rotating roller 351 and an adhesive component 352 wound around the rotating roller 351.

There has been desire to improve working efficiency in replacement of the sticking parts 35 with respect to the drive shaft 39 of the second drive unit 37. Hence, the rotating roller 351 is made of an elastic body such as a sponge, and a fit hole 353 into which the drive shaft 39 is fitted is formed at the center of the rotating roller 351. Other than the sponge, examples of the elastic body include rubber and foam. The inner diameter of the fit hole 353 is formed to be smaller than the outer diameter of the drive shaft 39. By pushing the drive shaft 39 into the fit hole 353, the rotating roller 351 contracts, and the drive shaft 39 fits in the fit hole 353. Consequently, at the replacement, the rotating roller 351 can be removed from the drive shaft 39 only by pulling the rotating roller 351 to be detached from the drive shaft 39. Thus, since the rotating roller 351 is elastic, the sticking part 35 can be easily put on and removed from the drive shaft 39, and accordingly the sticking part 35 can be easily replaced with another.

Figure 13:
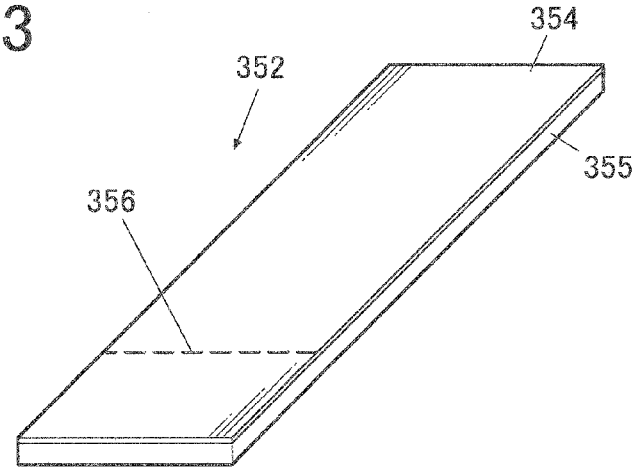
FIG. 13 is a perspective view schematically showing the structure of an adhesive component according to the embodiment.

FIG. 13 is a perspective view schematically showing the configuration of the adhesive component 352. As shown in FIG. 13, the adhesive component 352 is sheet-shaped and has, for example, a double-sided adhesive structure like a double-sided tape. The adhesive component 352 has a two-layer structure of a weak adhesive layer 354 and a strong adhesive layer 355. The weak adhesive layer 354 is provided on a side which sticks to the book B (surface side). The weak adhesive layer 354 has: weak adhesive power so that pieces of the weak adhesive layer 354 do not remain after the adhesive component 352 is removed; and a property that the weak adhesive layer 354 can be used multiple times. On the other hand, the strong adhesive layer 355 is provided on the opposite side. The strong adhesive layer 355 has adhesive power stronger than the weak adhesive layer 354 so that the strong adhesive layer 355 maintains a state of being wound around the rotating roller 351. Perforations 356 are formed at predetermined length intervals on the adhesive component 352.

Figure 14A:
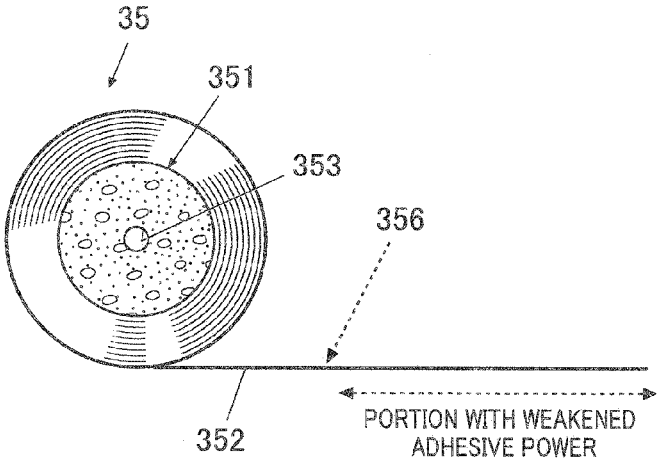
FIG. 14A and FIG. 14B illustrate a process of removing the adhesive component when the adhesive power has weakened.
Figure 14B:
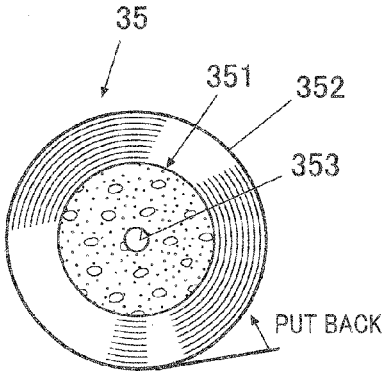

FIG. 14A and FIG. 14B illustrate a process of removing the adhesive component 352 when the adhesive power has weakened. When a user feels that the adhesive power has weakened, the user removes the most outer surface of the adhesive component 352 by one round to expose a new portion of the weak adhesive layer 354 of the adhesive component 352 as shown in FIG. 14A. Then, the portion, the adhesive power of which has weakened, is cut along the perforation 356. At the time of cutting, if a portion thereof temporarily peels off as shown in FIG. 14B, the user puts the portion back. Thus, a new portion of the weak adhesive layer 354 is exposed, so that the page-turning operation can be appropriately resumed.

Figure 15:
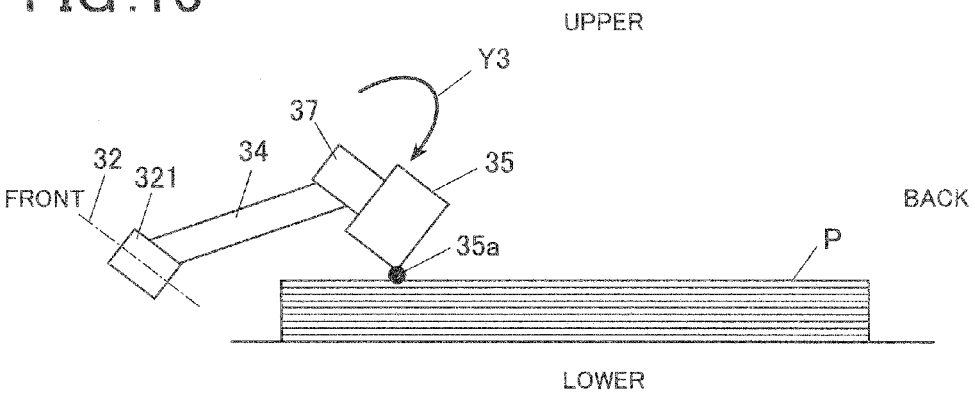
FIG. 15 is a schematic view of the sticking part according to the embodiment at an initial stage of contact with a page at a departure position.

FIG. 15 is a schematic view of the sticking part 35 at the initial stage of the contact with the page P at the departure position. As illustrated in FIG. 15, the arm part 34 moves in the direction of the arrow Y3, so that an effective (adhesive) surface of the sticking part 35 obliquely comes into contact with the page P at the departure position at the initial stage of the contact with the page P. In specific, the drive shafts 32, 39 and the arm part 34 each have a predetermined length and angle and are disposed at a predetermined position such that a part of one circumferential end portion 35*a* of the substantially-columnar sticking part 35 obliquely comes into contact with the page P. The effective surface of the sticking part 35 is the outer surface made of a generating line.

Since the effective surface of the sticking part 35 obliquely comes into contact with the page P, the area of the contact between the sticking part 35 and the page P at the initial stage of the contact is small. Thereby a high pressure can be applied on the page P. This ensures the sticking (adhesion) of the sticking part 35 to the page P.

Figure 16:
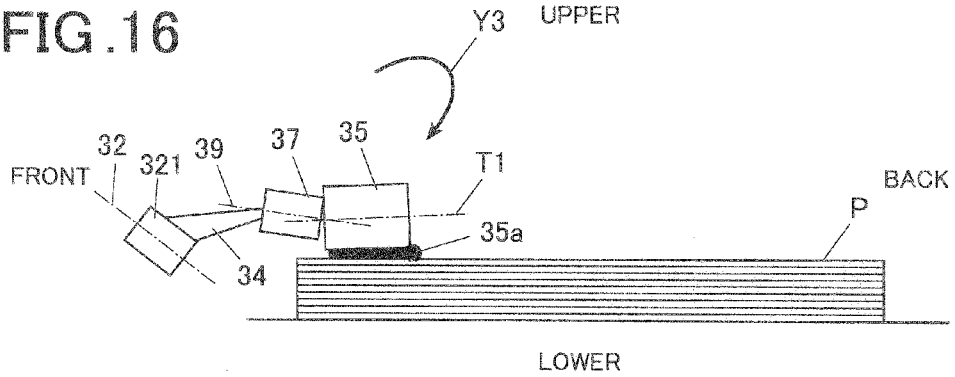
FIG. 16 is a schematic view of the sticking part according to the embodiment, the arm part of the sticking part having been moved from the position illustrated in FIG. 15.

FIG. 16 is a schematic view showing a state in which the arm part 34 has moved from the position illustrated in FIG. 15. The arm part 34 of the sticking part 35 at the initial stage of the contact with the page P at the departure position is still moved to the direction of the arrow Y3 by the first drive unit 33. Since the sticking part 35 remains in contact with the page P, the arm part 34 is twisted around its axis, which is parallel to the longitudinal direction of the arm part 34. The drive shaft 39 fitted into the rotating roller 351 is shifted from the central axis T1 of the rotating roller 351, so that a generating line (or a band including the generating line) of the sticking part 35 comes into close contact with the page P. The sticking part 35 is in close contact with the page P in a larger contact area than the area of the contact between the sticking part 35 and the page P at the initial stage of the contact.

Figure 17:
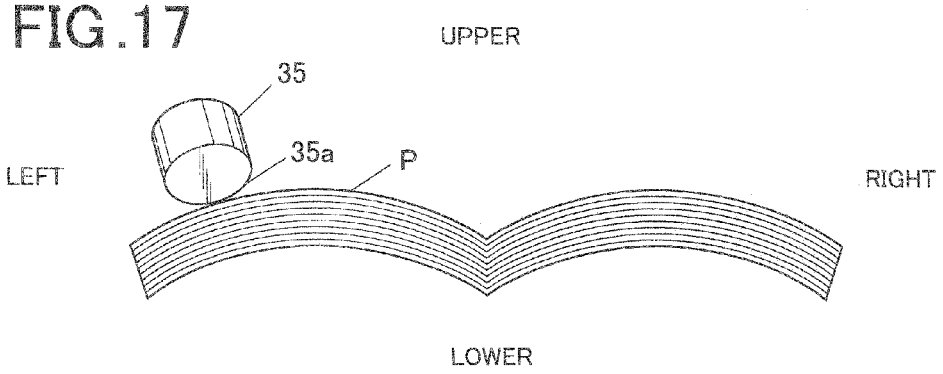
FIG. 17 is a schematic front view of the sticking part illustrated in FIG. 15.

FIG. 17 is a schematic front view of the sticking part of FIG. 15. As shown in FIG. 17, even if the page P at the departure position is warped, the effective surface of the sticking part 35 can obliquely come into contact with the page P. The area of the contact between the sticking part 35 and the page P at the initial stage of the contact is thus small. This can apply a high pressure on the page P, ensuring effective sticking of the sticking part 35 to the page P.

Such a two-step sticking operation of the sticking part 35 ensures the sticking of the sticking part 35 to the page P.

As shown in FIGS. 1 and 2, the blower 5 is disposed upstream from the departure position of the book B. For example, when a page P of the book B is turned from left to right as in the present embodiment, the blower 5 is disposed on the left side of pages P which is placed at the departure position of the book B. The blower 5 is supported by a turn shaft 51 such that the blower 5 is horizontally turned about the turn shaft 51 in the second accommodation recess 312. The direction of the air from the blower 5 is thus adjustable. Alternatively, the blower 5 may be turned about two or more shafts, provided that the direction of the air is adjustable. In the use of two shafts, the blower 5 should preferably be turned in both the horizontal and vertical directions. Alternatively, the blower 5 may be installed in the second accommodation recess 312 with a pivot mechanism or any other mechanism that has a variable rotation axis.

Figure 18:
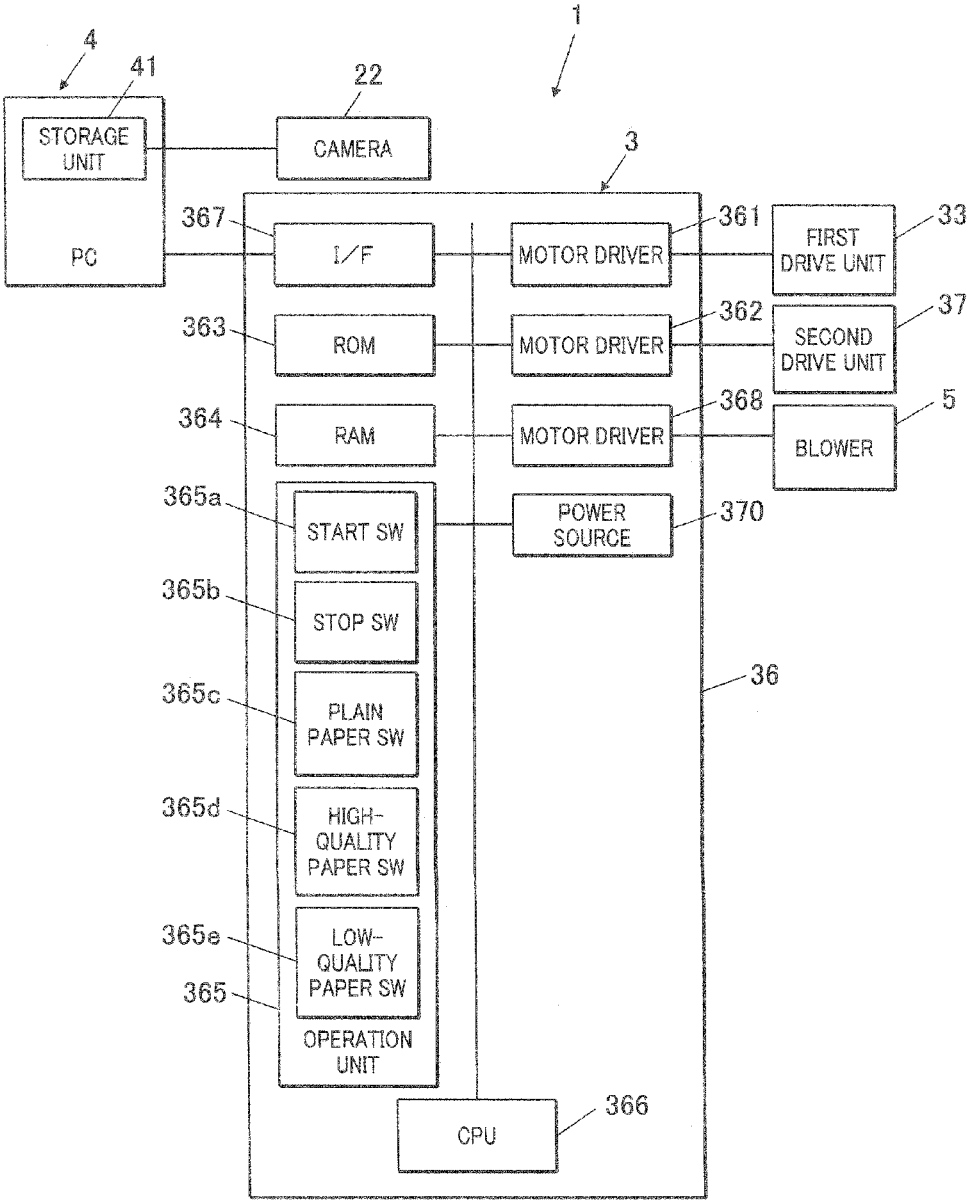
FIG. 18 is a block diagram showing the main control configuration of the document camera system according to the embodiment.

Next, the main control configuration of the document camera system 1 according to the present embodiment will be explained. FIG. 18 is a block diagram showing the main control configuration of the document camera system 1. As shown in FIG. 18, the control unit 36 of the page-turning device 3 includes: a motor driver 361 which drives the first drive unit 33; a motor driver 362 which drives the second drive unit 37; a motor driver 368 which drives the blower 5; a ROM 363 where a variety of programs are stored; a RAM 364 where the programs stored in the ROM 363 are opened when the programs are executed; an operation unit 365 where a variety of instructions are inputted; a CPU 366 which controls the motor drivers 361 and 362 by opening and executing the programs, which are stored in the ROM 363, in the RAM 364 on the basis of the instructions from the operation unit 365; an I/F 367 to which the personal computer 4 is connected; and a power source 370.

The operation unit 365 includes a start switch 365*a* for starting page-turning processing and a stop switch 365*b* for stopping the page-turning processing. The CPU 366 counts a number of the pages, as a value N, which are turned since the start switch 365*a* is operated until the stop switch 365*b* is operated. The value N is stored in the RAM 364.

The operation unit 365 includes a plain paper switch 365*c*, a high-quality paper switch 365*d* and a low-quality paper switch 365*e* for specifying a kind of paper of a page P of the book B. Only one of the plain paper switch 365*c*, the high-quality paper switch 365*d* and the low-quality paper switch 365*e* can be pushed down at once. The CPU 366 recognizes the kind of paper of a page P to be turned on the basis of the switch which is pushed down (one of the plain paper switch 365*c*, the high-quality paper switch 365*d* and the low-quality paper switch 365*e*) when the start switch 365*a* is operated.

Figure 19:
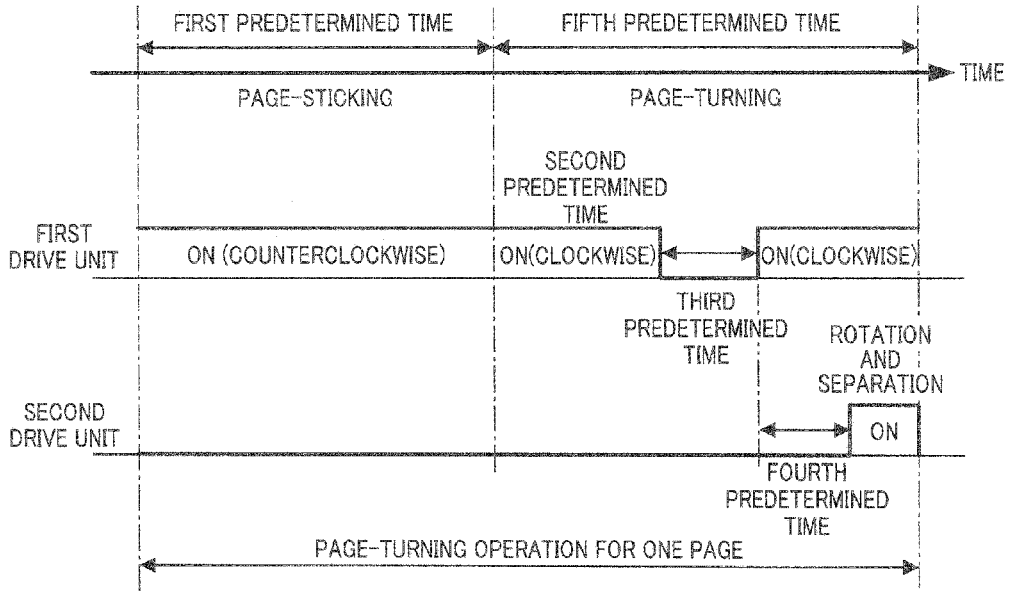
FIG. 19 is a timing chart showing drive timings of the first drive unit and the second drive unit in the page-turning operation for one page according to the embodiment.

FIG. 19 illustrates drive timings of the first drive unit 33 and the second drive unit 37 in the page-turning operation of one page.

A first predetermined time is set at a time length enough for the arm part 34 to move from the start point to the end point of the homeward movement. By changing the first predetermined time, the swing period of the arm part 34 during the homeward movement can be adjusted.

Adhesive power of paper to the sticking part 35 is different depending on the kind of the paper. For example, high-quality paper has a property that it is easy to be adhered to the sticking part 35 and difficult to be separated from the sticking part 35, In contrast, low-quality paper has a property that it is difficult to be adhered to the sticking part 35 and easy to be separated from the sticking part 35. The plain paper has a property being intermediate between the high-quality paper and the low-quality paper. Smooth adherence and separation may be difficult to be carried out depending on the kind of paper. Thus, it is desired to adjust the adhesive power for each kind of paper. If the swing period described above of the arm part 34 during the homeward movement is adjusted, the pressure to a page P can be adjusted, and thus, the adhesive power can be adjusted.

The first predetermined time for each kind of paper is stored in the ROM 363. The relation among the first predetermined times for the three kinds of paper described above is as follows: the first predetermined time for the low-quality paper>the first predetermined time for the plain paper>the first predetermined time for the high-quality paper. As specific examples, the first predetermined time for the low-quality paper is 1.1 seconds, the first predetermined time for the plain paper is 1.0 second and the first predetermined time for the high-quality paper is 0.9 seconds.

Preferably, these first predetermined times are respectively adjusted within 20% of these standard first predetermined times in order to prevent the first predetermined time becomes too lengthy.

The first predetermined time may be adjusted depending on changes in ambient temperature or humidity.

A second predetermined time is set at a time length enough for the arm part 34 to move from the start point of the outward movement to a predetermined position. Preferably, the length between the start point and the predetermined position is less than a half length of the outward movement.

A third predetermined time is set at a time length during which the arm part 34 is temporarily stopped at the predetermined position. The third predetermined time is set such that, when the arm part 34 is stopped during the third predetermined time, an overlapped page P separates.

A fourth predetermined time is set at a time length between the time when the arm part 34 restarts the outward movement from the predetermined position and the time when the second drive unit 37 starts to be driven. Preferably, the fourth predetermined time is set from a time for the arm part 34 to move from the predetermined position to around the middle point of the outward movement to a time for the arm part 34 to move from the predetermined position to almost the end point of the outward movement.

A fifth predetermined time is set at a time length enough for the arm part 34 to move from the start point to the end point of the outward movement while temporarily stopping. That is, the fifth predetermined time is set as time period which is longer than the sum of the second predetermined time, the third predetermined time and the fourth predetermined time.

Processing of the document camera system 1 will be explained hereinafter.

First, preparation before execution of the processing will be explained.

A user opens the lid 42 of the turning unit 30 for a standby mode. Then, the user turns the mount 38 about the turn shaft 384 to draw out the mount 38 from the case 31 so that the arm part 34 is switched to an operation mode in which the arm part 34 is operated (see FIGS. 1 and 2). The user then disposes the support base 6 on the open lid 42, and places the book B on the support base 6. The user then adjusts the direction of the wind from the blower 5 such that the wind passes above pages P at the departure position and blows against pages P at the destination position. The direction of the wind is indicated by an arrow Y2 in the drawings.

The position of the arm part 34 is adjusted such that the sticking part 35 is disposed at the start point (the end point of the homeward movement) in advance. In specific, the user further adjusts the position of the support base 6 such that the sticking part 35 abuts on the upper left portion of the page P at the departure position (see FIGS. 1 and 2).

Figure 20:
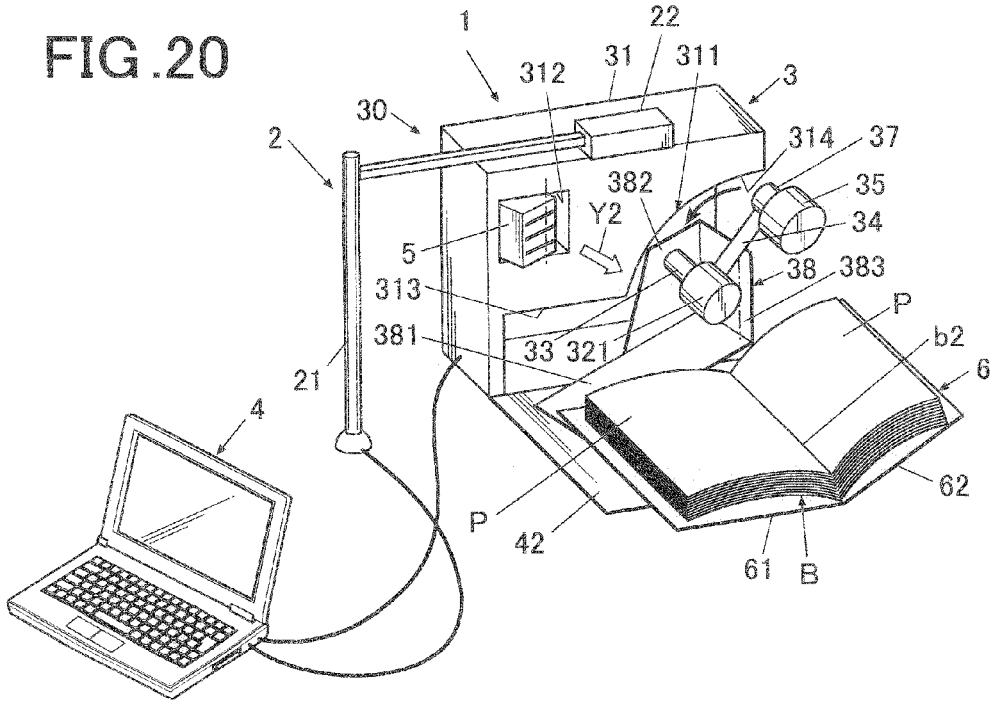
FIG. 20 is a perspective view showing a prepared state of the document camera system according to the embodiment.

The user then checks the adhesive power of the adhesive component 352. If the adhesive power is weak, the user peels off the weak portion to expose a new portion of the adhesive component 352. The user then opens the book B to expose the page P previous to the first page P to be scanned, and moves the sticking part 35 to the end point of the outward movement (the start point of the homeward movement). At this time, as shown in FIG. 20, the position where the arm part 34 is supported by the stopper 383 corresponds to the end point of the outward movement (the start point of the homeward movement).

Thus the preparation is done, and when the user turns on the power source 370 of the page-turning device 3, the CPU 366 opens in the RAM 364 a program for the page-turning processing stored in the ROM 363 to execute the program.

Figure 21:
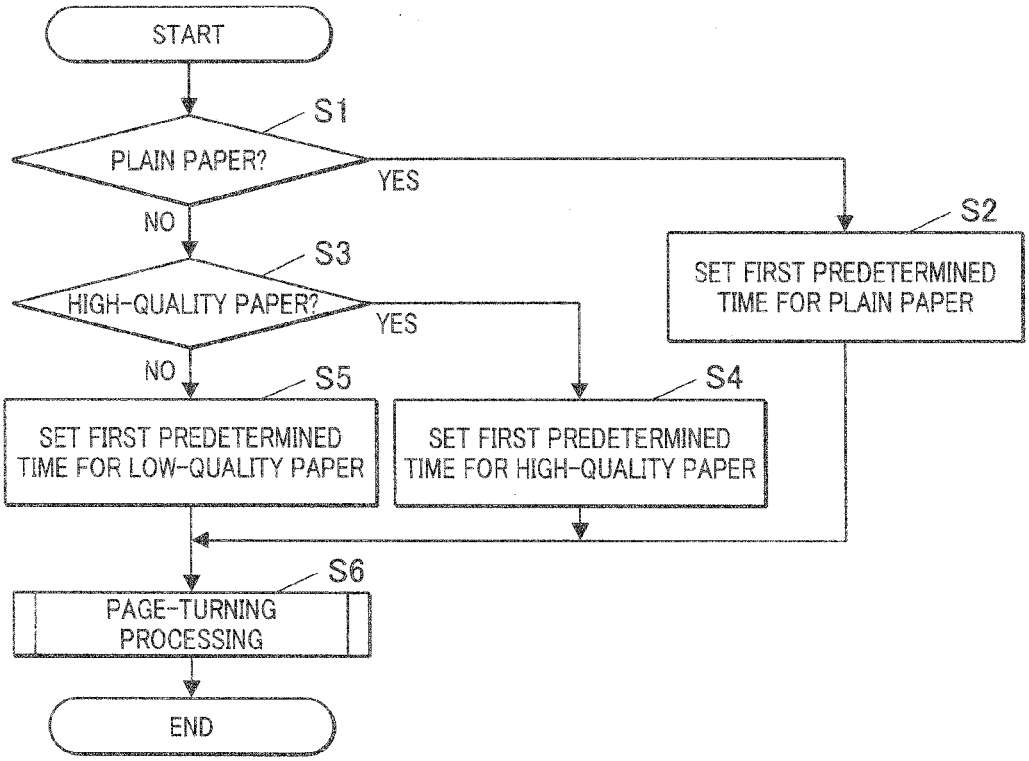
FIG. 21 is a flowchart of processing by the page-turning device of the embodiment.

FIG. 21 is a flowchart showing the processing of the document camera system 1.

The user pushes down one of the switches 365*c*, 365*d* and 365*e*, which corresponds to the kind of paper of the page P to be turned, to input the kind of paper to the page-turning device 3.

At Step S1, the CPU 366 determines whether or not the plain paper switch 365*c* is pushed down by a user. When determining that the plain paper switch 365*c* is pushed down, the CPU 366 shifts the processing to Step S2. When determining that the plain paper switch 365*c* is not pushed down, the CPU 366 shifts the processing to Step S3.

At Step S2, the CPU 366 sets the first predetermined time at a value for plain paper and shifts the processing to Step S6.

At Step S3, the CPU 366 determines whether or not the high-quality paper switch 365*d* is pushed down by the user. When determining that the high-quality paper switch 365*d* is pushed down, the CPU 366 shifts the processing to Step S4. When determining that the high-quality paper switch 365*d* is not pushed down, the CPU shifts the processing to Step S5.

At Step S4, the CPU 366 sets the first predetermined time at a value for high-quality paper and shifts the processing to Step S6.

At Step S5, the CPU 366 sets the first predetermined time at a value for low-quality paper and shifts the processing to Step S6.

At Step S6, the page-turning processing is carried out.

FIG. 22 is a flowchart of the page-turning processing.

As shown in FIG. 22, at Step S61, the CPU 366 determines whether or not the start switch 365*a* is operated by the user. When determining that the start switch 365*a* is not operated, the CPU 366 keeps the state as it is. When determining that the start switch 365*a* is operated, the CPU 366 shifts the processing to Step S62.

At Step S62, the CPU 366 resets the value N, which is stored in the RAM 364, at zero.

At Step S63, the CPU 366 drives the blower 5 to carry out blowing with the blower 5.

At Step S64, the CPU 366 controls the first drive unit 33 such that the arm part 34 moves from right to left (homeward movement).

At Step S65, the CPU 366 determines whether or not a driving time of the first drive unit 33 exceeds the first predetermined time. When determining that the driving time does not exceed the first predetermined time, the CPU 366 keeps driving the first drive unit 33. When determining that the driving time exceeds the first predetermined time, the CPU 366 shifts the processing to Step S66.

At Step S66, the CPU 366 stops the first drive unit 33. Thereby, the sticking part 35 sticks to a page P on the left with rotation of the sticking part 35 being stopped (see FIGS. 1 and 2).

At Step S67, the CPU 366 controls the first drive unit 33 such that the arm part 34 moves from left to right (outward movement). In response to this control, the page P starts to be turned from the departure position to the destination position while sticking to the sticking part 35.

At Step S68, the CPU 366 determines whether or not a driving time of the first drive unit 33 exceeds the second predetermined time. When determining that the driving time does not exceed the second predetermined time, the CPU 366 keeps driving the first drive unit 33. When determining that the driving time exceeds the second predetermined time, the CPU shifts the processing to Step S69.

Figure 23:
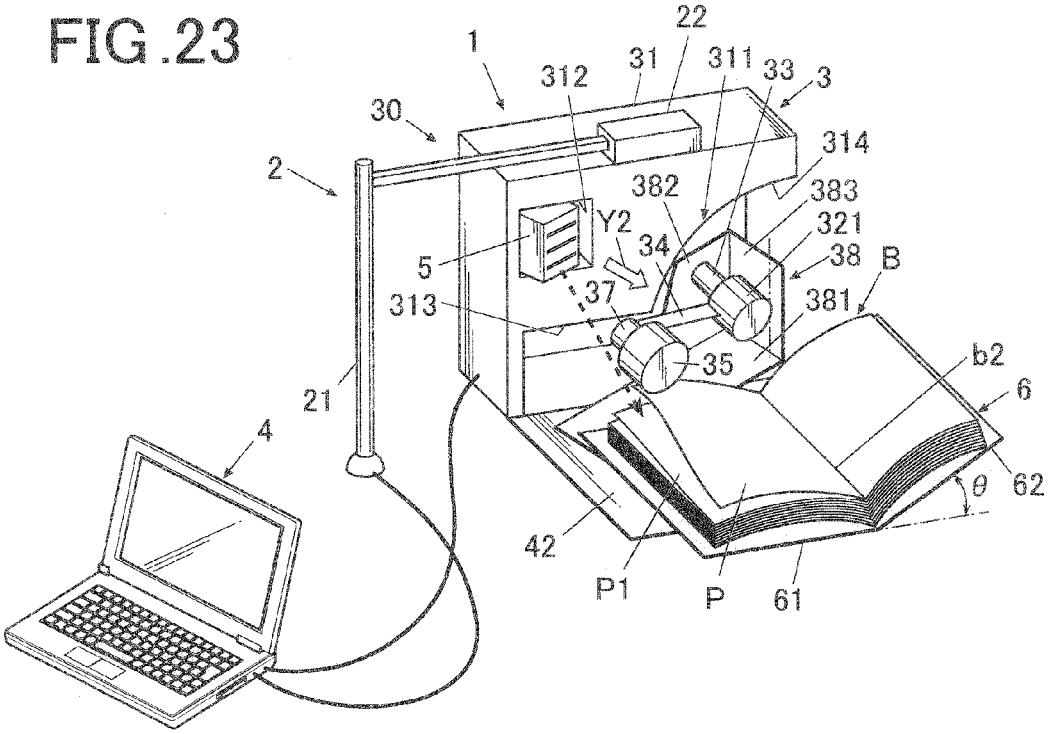
FIG. 23 is a perspective view showing one state of the document camera system being operated according to the embodiment.

At Step S69, the CPU 366 stops the first drive unit 33 to stop the arm part 34 at the predetermined position. Even if another page P1 is overlapped with the page P which sticks to the sticking part 35, the other page P1 is released from the page P due to vibrations caused by the stopping of the arm part 34 (see FIG. 23). In this case, when the page P adhered to the sticking part 35 and the other page P1 separates from each other, air from the blower 5 enters a gap between the pages P and P1 and this air flow ensures that the other page P1 separates from the page P.

At Step S70, the CPU 366 determines whether or not a stop time during which the first drive unit 33 stops exceeds the third predetermined time. When determining that the stop time does not exceed the third predetermined time, the CPU 366 continues to stop the first drive unit 33. When determining that the stop time exceeds the third predetermined time, the CPU 366 shifts the processing to Step S71. Air continues to be blown between the pages P and P1 until the third predetermined time elapses.

At Step S71, the CPU 366 controls the first drive unit 33 such that the arm part 34 restarts to move from the predetermined position (outward movement).

At Step S72, the CPU 366 determines whether or not a driving time of the first drive unit 33 exceeds the fourth predetermined time. When determining that the driving time does not exceed the fourth predetermined time, the CPU 366 keeps driving the first drive unit 33. When determining that the driving time exceeds the fourth predetermined time, the CPU shifts the processing to Step S73.

Figure 24:
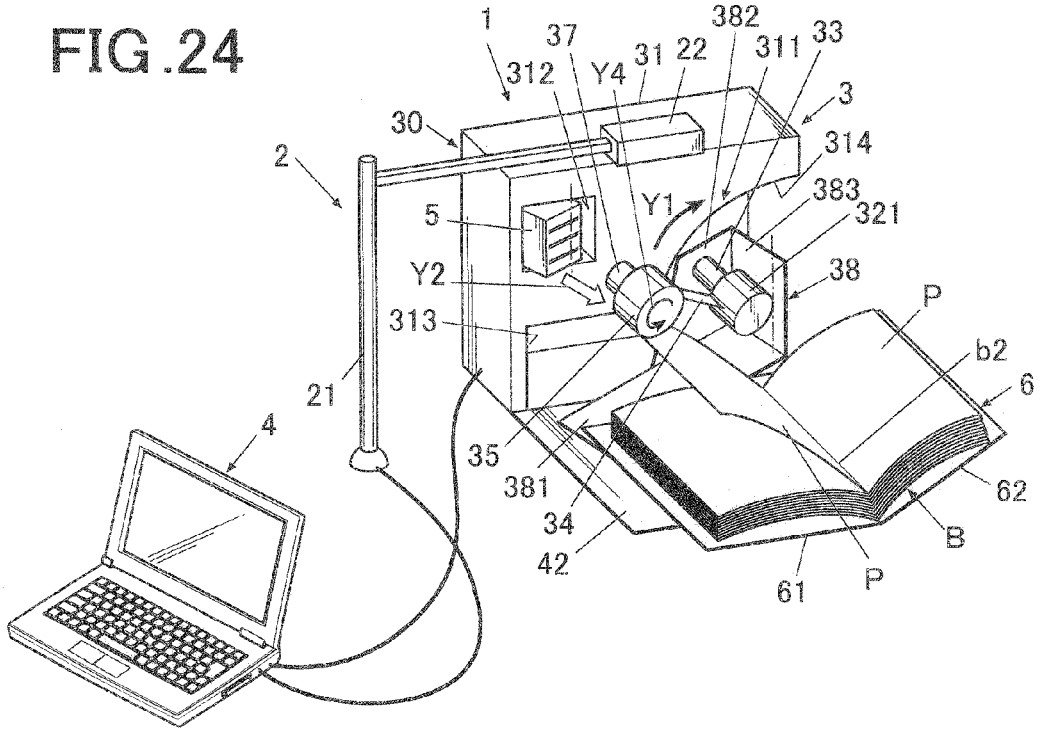
FIG. 24 is a perspective view showing another state of the document camera system being operated according to the embodiment.

At Step S73, the CPU 366 controls the second drive unit 37 to rotate the sticking part 35 while keeping driving the first drive unit 33. This rotation changes the adhesive power of the sticking part 35 when the sticking part 35 separates from a page P, so that the sticking part 35 can reliably separate from the page P. The arm part 34 rotates clockwise in the outward movement as shown in FIG. 24 (arrow Y1). In order to improve the separation performance, it is preferable that the second drive unit 37 rotates the sticking part 35 in a direction opposite to the swing direction of the arm part 34, i.e. counterclockwise (arrow 4).

At Step S74, the CPU 366 determines whether or not the elapsed time since a start of the page-turning processing exceeds the fifth predetermined time. When determining that the elapsed time does not exceed the fifth predetermined time, the CPU 366 continues to drive the first drive unit 33 and the second drive unit 37. When determining that the elapsed time exceeds the fifth predetermined time, the CPU 366 shifts the processing to Step S75.

At Step S75, the CPU 366 stops the first drive unit 33 and the second drive unit 37. At this time, the arm part 34 has inertia to let the arm part 34 rotate clockwise. However, the further rotation of the arm part 34 is restricted by the stopper 383. That is, the stopper 383 restricts, between the outward movement and the homeward movement of the arm part 34, the moveable range of the arm part 34 on the side of the destination position.

The sticking page P is separated from the sticking part 35 while the second drive unit 37 rotates. The wind from the blower 5 blows against the page P released from the sticking part 35, and thus can guide the page P to the destination position while preventing the page P from returning to the departure position. The sticking part 35 is located at a position apart from pages P of the destination position with no page P sticking thereto. The sticking part 35 and the arm part 34 at this position are outside the angle of view of the camera 22.

At Step S76, the CPU 366 outputs a signal which indicates completion of the page-turning processing to the personal computer 4.

At Step S77, the computer 4 controls the camera 22 on the basis of the inputted signal which indicates completion of the page-turning operation so that the pages P opened at present (spread state) are imaged (image pickup). At the time, since the sticking part 35, the arm part 34 and the blower 5 are outside the angle of view of the camera 22, only the pages P opened at present are imaged. Picked-up image data generated by the camera 22 are numbered one by one (each imaging) and stored in a storage unit 41 of the computer 4.

In a preferred embodiment, Step S77 may involve capturing images on only odd-numbered flat pages P at the departure position, placing even-numbered pages P at the departure position, capturing images on even-numbered pages P, and collating all the pages P in numerical order into one scanned image, instead of capturing opened two pages P at once.

At Step S78, the CPU 366 adds one to the value N and stores the result in the RAM 364.

At Step S79, the CPU 366 determines whether or not the stop switch 365*b* is operated. When determining that the stop switch 365*b* is not operated, the CPU 366 shifts the processing to Step S2. When determining that the stop switch 365*b* is operated, the CPU 366 ends the page-turning processing. Thereby, the page-turning operation and the image pickup operation are alternately carried out, and image pickup of designated pages P is completed.

As described above, according to the present embodiment, when the sticking part 35 swings from the departure position to the destination position, the arm part 34 temporarily stops, and thus, even if multiple pages P and P1 are turned by the sticking part 35 in an overlapped state, the pages P and P1 separates due to the vibration caused by the temporary stop. Therefore, multiple pages P and P1 are prevented from being turned in the overlapped state.

Since the adhesive power of the sticking part 35 to the page P is adjustable, the adhesive power is adjusted so as to be suitable for the kind of paper and environment.

Since the adhesive power of the sticking part 35 is adjusted by adjusting the swing period of the arm part 34, the adhesive power is adjusted by a simple control.

In the present embodiment, since the swing period of the arm part 34 is adjusted depending on the kind of paper of a page P, the pressure of the sticking part 35 to be applied onto the page P is adjusted for each kind of paper and the adhesive power suitable for each kind of paper can be realized. Thus, each of pages P of various kinds of paper is stuck with a suitable adhesive power and reliable sticking to each kind of paper is possible. Since it is possible to prevent the adhesive power from becoming too large, the page P is prevented from being damaged.

Since the first predetermined time is adjusted within 20% of the standard first predetermined time for each kind of paper, too large length of the swing period of the arm part 34 can be suppressed.

Since the swing period of the sticking part 35 is adjusted only along the direction from the destination position to the departure position, the swing period is not adjusted for the movement of the sticking part 35 which does not relate to sticking, and thus, efficiency of the processing can be improved.

Since the page P is adhered to the adhesive component 352 provided at the sticking part 35, the configuration is simpler in comparison to a case where a page P is pulled by a suction mechanism.

Since the wind from the blower 5 passes above pages P at the departure position and blows against pages P at the destination position, it is possible to prevent the wind from adversely affecting pages P at the departure position and to let the wind push pages P at the destination position.

Furthermore, when multiple pages P and P1 separate from each other due to a temporary stop of the arm part 34, the air from the blower 5 enters a gap between these pages P and P1. This air flow allows the page P1 to be reliably separated from the page P.

Thereby, the reliability of the turning-page processing can be improved.

The present invention is not limited to the above embodiment, and several modifications can be applied thereto appropriately.

For example, in the above embodiment, the sticking part 35 has the adhesive component 352, and the sticking part 35 sticks to a page P by the adhesive power of the adhesive component 352. However, it is also possible that the sticking part 35 sticks to a page P by suction, etc. In this case, for example, a communicating hole which communicates with an inner space of the sticking part is formed on the circumference surface of the sticking part so that the inner space of the sticking part and a pump communicate with each other, and by driving the pump such that the inner space is under negative pressure, sucking power acts onto the communicating hole. Thereby, the sticking part can stick to a page P by the suction power.

Other than suction and adhesion, sticking by electrostatic attraction can be applied to the sticking part.

In the above embodiment, a case is explained, as an example, where the adhesive power of the sticking part 35 is adjusted by adjusting the swing period of the arm part 34. However, the adhesive power of the sticking part 35 to the page P can be adjusted by adjusting voltage of the first drive unit 33. Specifically, when the voltage of the first drive unit 33 is adjusted, pressure of the sticking part 35 applied onto a page P can be adjusted, and thus, the adhesive power of the sticking part 35 to the page p can be adjusted.

Some embodiments of the present invention are described. The above-described embodiments should not be construed to limit the invention. The scope of the invention is defined by the following claims and equivalents thereof.

What is claimed is:

1. An apparatus which turns a page of an open book, comprising:

a turning mechanism which brings a predetermined member into contact with a page at a departure position and separates the page from the predetermined member at a destination position, the page being moved with the predetermined member;

a drive unit which drives the turning mechanism to make the predetermined member perform a to-and-fro movement between the departure position and the destination position; and a control unit which controls the drive unit to temporarily stop the movement of the predetermined member on a way to the destination position from the departure position.

2. The apparatus according to claim 1, wherein the turning mechanism includes an arm part, the predetermined member is attached to a tip portion of the arm part which moves such that the tip portion travels along an archwise path, and the tip portion of the arm part is vibrated by inertia of the predetermined member when the movement of the arm part is stopped.

3. The apparatus according to claim 1, wherein the control unit adjusts adhesion power of the predetermined member applied to the page by changing time of the contact of the predetermined member onto the page at the departure position.

4. The apparatus according to claim 1, wherein the control unit adjusts adhesion power of the predetermined member applied to the page by changing pressure of the contact of the predetermined member onto the page at the departure position.

5. The apparatus according to claim 1, wherein the control unit adjusts adhesion power of the predetermined member applied to the page by changing a period of the to-and-fro movement of the predetermined member.

6. The apparatus according to claim 1, wherein the control unit adjusts a period of the to-and-fro movement of the predetermined member based on a kind of paper of the page.

7. The apparatus according to claim 1, wherein the control unit adjusts a period of the to-and-fro movement of the predetermined member by changing a time length of the movement of the predetermined member from the destination position to the departure position.

8. The apparatus according to claim 1, wherein the predetermined member is an adhesive component and the adhesive component sticks to the page.

9. The apparatus according to claim 1, further comprising a blower which sends air above a page at the departure position to blow against a page at the destination position.

10. A method for turning a page of an open book, comprising:

making a predetermined member perform a to-and-fro movement between a departure position and a destination position such that the predetermined member is brought into contact with a page at the departure position and the page is separated from the predetermined member at the destination position, the page being moved with the predetermined member; and stopping the predetermined member temporarily on a way to the destination position from the departure position.

* * * * *